US006179154B1

(12) United States Patent
Spicola et al.

(10) Patent No.: US 6,179,154 B1
(45) **Date of Patent: *Jan. 30, 2001**

(54) INSERT FOR AN OPENING IN A COMPOSITE MATERIAL PRESSURE VESSEL

(75) Inventors: Francis C. Spicola, Portsmouth, RI (US); Stephen J. Plunkett, Portsmouth, NH (US)

(73) Assignee: The United States of America as represented by the Secretary of the Navy, Washington, DC (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/843,809

(22) Filed: Apr. 21, 1997

(51) Int. Cl.[7] ..... B65D 1/48; B65D 25/00; F17C 1/02

(52) U.S. Cl. ..... 220/586; 220/62.22; 220/560.04; 220/592; 220/644; 220/661

(58) Field of Search ..... 220/560.04, 640, 220/645, 651, 661, 676, DIG. 23, 584, 585, 586, 587, 588, 589, 590, 592, 582, 581, 62.22, 644

(56) References Cited

U.S. PATENT DOCUMENTS

| | | | | |
|---|---|---|---|---|
| 3,298,560 | * | 1/1967 | Anderson | 220/661 |
| 4,282,974 | * | 8/1981 | Quandel | 220/661 |
| 4,614,279 | * | 9/1986 | Toth et al. | 220/661 |
| 4,685,589 | * | 8/1987 | Benton | 220/590 |
| 4,700,868 | * | 10/1987 | Dirkin | 220/590 |
| 4,765,507 | * | 8/1988 | Yavorsky et al. | 220/661 X |
| 5,312,867 | * | 5/1994 | Mitsuno et al. | 525/66 |

* cited by examiner

*Primary Examiner*—Stephen K. Cronin
*Assistant Examiner*—Niki M. Eloshway
(74) *Attorney, Agent, or Firm*—MIchael J. McGowan; James M. Kasischke; Prithvi C. Lall

(57) ABSTRACT

A pressure vessel insert comprises a plate having an outboard surface and an inboard surface interconnected by outer edge surfaces, and defining an aperture extending therethrough from the outboard surface to the inboard surface. The plate is provided with a modulus of elasticity within about 30% of a first modulus of elasticity of inboard and outboard skins of a wall portion of the pressure vessel shell around an opening in which the insert is disposed, in directions through the thickness of the skins.

16 Claims, 3 Drawing Sheets

INSERT FOR AN OPENING IN A COMPOSITE MATERIAL PRESSURE VESSEL

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The invention relates to pressure vessels, and is directed more particularly to an insert which fills an opening in a wall of such a vessel, frames a smaller aperture, and serves as a mounting for an aperture closure member, such as a hatch or acoustical device.

(2) Description of the Prior Art

The United States Navy originally developed a deep diving shell in the warhead section of a practice torpedo. Such shells typically contain transducers and recorders which provide a record as to the performance of a torpedo in a trial or test, such as a simulated attack, or the like.

The shell is cylindrically-shaped and is provided with a layered wall having a core of an aluminum honeycomb structure, bounded by inboard and outboard composite skins of glass fiber reinforced epoxy. The honeycomb core is about 1.1 inch thick and the composite skins are each about 0.1 inch thick. When it is desired to provide an opening in the shell wall for access or for mounting of a transducer, or the like, it is necessary to provide a frame having an aperture therein and having means for supporting an access hatch, or an instrument, and for providing strength to the aperture defined thereby. The honeycomb shell wall structure lacks the strength to support an aperture therein. Accordingly, an insert typically is provided for filling the opening in the shell wall, the insert having sufficient strength to support an aperture therein and a selected closure member.

The inserts used heretofore have generally been of aluminum. When aluminum inserts are used with shells having wall skins of glass-epoxy composites, the modulus of elasticity of the insert exceeds the modulus of elasticity of the wall skins by over 400% in a direction through the thickness of the skins. Failures have resulted from the mismatch of moduli of elasticity. A problem that one encounters in attempting to correct such imbalance, is the fact that the shell skins have widely varying moduli of elasticity in directions through the thickness, longitudinally, and through the "hoop", that is, through the curve of the wall skin. It has been found difficult to provide an insert having a modulus of elasticity substantially equal to the shell skin moduli in all three directions.

Thus, there is a need for an insert having a modulus of elasticity similar to the "through the thickness" modulus of elasticity of the shell wall skins and relatively close to the transverse, or "hoop", and longitudinal moduli of elasticity of the shell wall skins.

Inserts are also necessary in conventional pressure vessels containing a pressurized gas or fluid. The one difference is that the pressurized environment is on the interior of the pressure vessel wall. Similar problems occur with openings in these walls.

SUMMARY OF THE INVENTION

It is, therefore, an object of the invention to provide an insert for a pressure vessel, the insert having sufficient strength to support an aperture therein and having a modulus of elasticity reasonably close to three moduli of elasticity present in the walls of the vessel and extending in three different directions.

With the above and other objects in view, as will hereinafter appear, a feature of the present invention is the provision of an insert for an opening in a pressure vessel wall having a central core sandwiched between inboard and outboard skins. The insert is adapted to support a closure member. The insert comprises a compression molded composite plate having an outboard surface and an inboard surface interconnected by outer edge surfaces, and defining an aperture extending therethrough from the plate outboard surface to the plate inboard surface. The plate is provided with a modulus of elasticity, in a direction through the thickness of the plate, which is within about 30% of a first modulus of elasticity of the pressure vessel wall inboard and outboard skins in directions through the thicknesses of the skins. The plate modulus of elasticity is further within about 30% of a second modulus of elasticity of the wall inboard and outboard skins in a widthwise, or "hoop", direction. The plate modulus of elasticity is still further within about 15% of a third modulus of elasticity of the wall inboard and outboard skins in a longitudinal direction.

The above and other features of the invention, including various details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
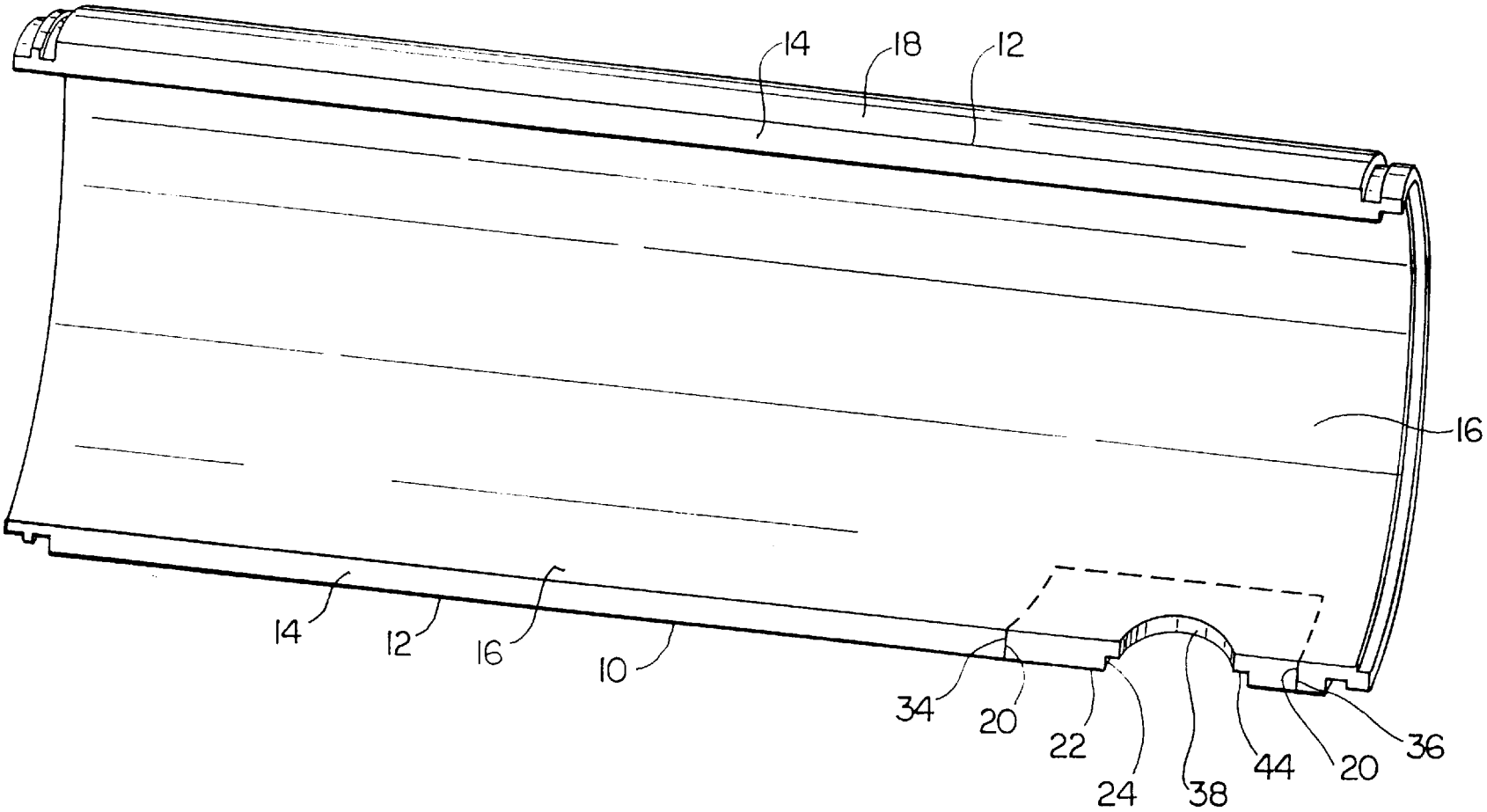
FIG. 1 is a perspective view of a wall portion of a pressure vessel with an insert fixed thereto; the insert being illustrative of an embodiment of the invention.

Referring to FIG. 1, it will be seen that a pressure vessel 10 includes a cylindrically-shaped wall 12 having a honeycomb core 14 of metal, usually aluminum, sandwiched between an inboard composite skin 16 and an outboard composite skin 18. The composite skins 16, 18 are typically of fiber glass-reinforced epoxy and are each about 0.1 inch thick. The honeycomb core 14 is about 1.1 inches thick. The shell wall 12 is provided with an opening 20 for the mounting of an access hatch, a transducer or other instrument, or other closure member (not shown).

Figure 2:
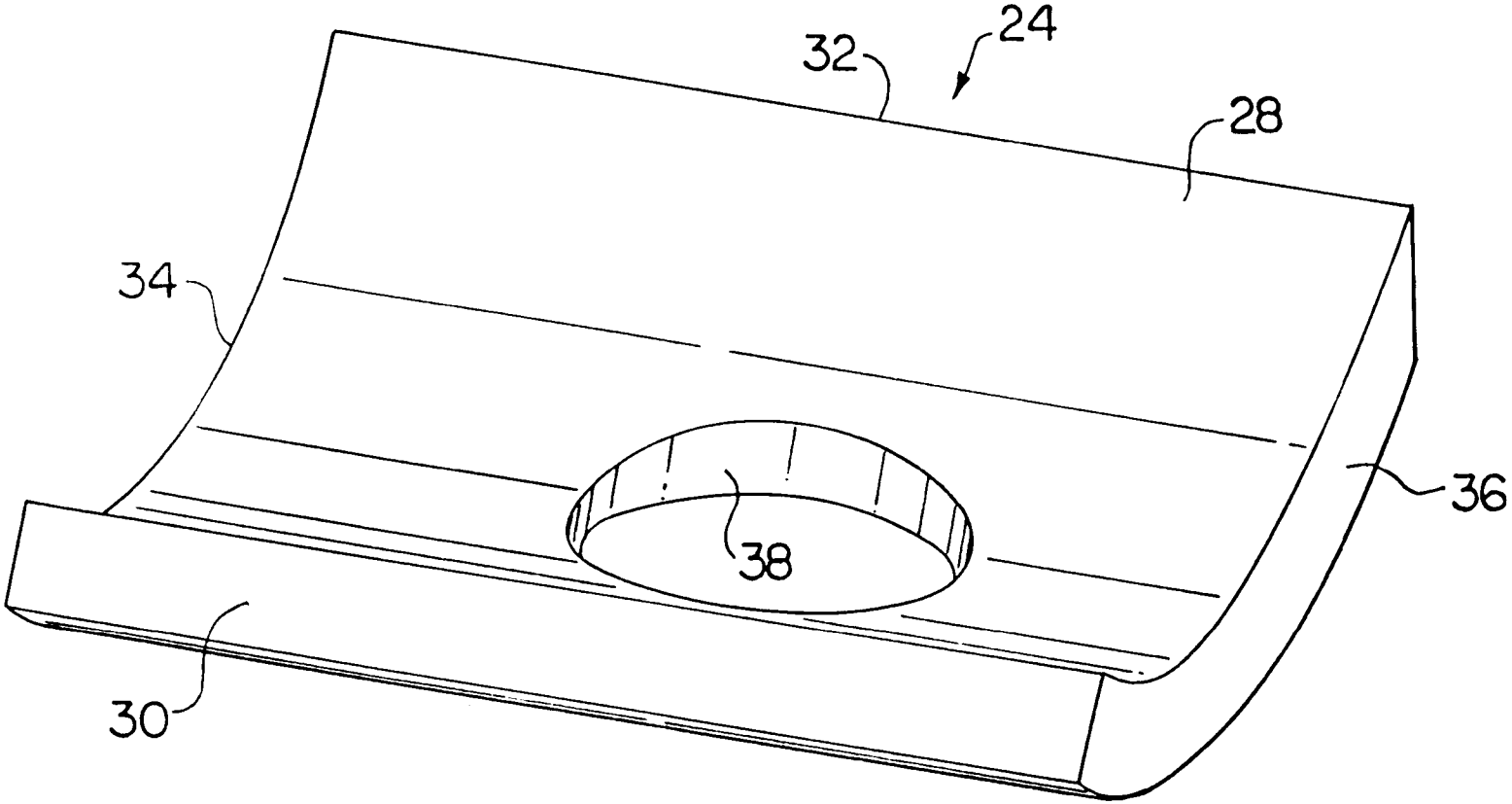
FIG. 2 is an enlarged perspective view of a plate portion of the insert of FIG. 1.

An insert 22 (FIGS. 1–3) is inserted between inboard composite skin 16 and outboard composite skin 18 and into the opening 20 and fixed therein. The insert 22 includes a plate 24 having an outboard surface 26 and an inboard surface 28 interconnected by outer edge surfaces 30, 32, 34 and 36 (FIG. 2) and defining an aperture 38 extending therethrough from plate outboard surface 26 to plate inboard surface 28.

The plate 24 is compression molded with a curvature equal to the curvature of shell wall 12. The plate 24 is of a non-metallic composite material, preferably a glass-reinforced epoxy having glass fibers (preferably "S2" fibers) randomly dispersed therein. The plate 24 is of a thickness of about 1.1 inches, is provided with a modulus of elasticity of about 2.3 million p.s.i., a density of about 0.066 lbs./in$^3$, and a compressive yield strength of up to about 35,000 p.s.i.

In the shell wall inboard and outboard skins 16, 18, the reinforcing glass fibers are oriented in a ±54° pattern relative to the longitudinal direction of the shell. Accordingly, the skins 16, 18 exhibit a different modulus of elasticity in the "through the thickness" direction, (about 1.8 million p.s.i.) the longitudinal direction (about 2.66 million p.s.i.) and the "hoop" direction (about 3.3 million p.s.i.). The modulus through the thickness is of greatest importance for this application. Thus, the modulus of elasticity of plate 24 is about 30% greater than the "through the thickness" modulus of skins 16, 18, about 15% less than the longitudinal modulus of skins 16, 18, and about 30% less than the "hoop" modulus of skins 16, 18. The modulus of elasticity for aluminum inserts is about 10 million p.s.i., or 550% greater than the shell skins "through the thickness" modulus, about 376% greater than the shell skins longitudinal direction modulus, and about 300% greater than the shell skins "hoop" direction modulus.

The insert further includes a continuation of the shell wall outboard skin 18 covering and fixed to the plate outboard surface 26 and a continuation of the shell wall inboard skin 16 covering and fixed to the plate inboard surface 28. The plate 24 is of a thickness of about 1.1 inch, corresponding to the thickness of the shell wall core 14, and the plate skins are each of a thickness of about 0.1 inch, corresponding to the thicknesses of the shell wall skins 18, 16. Thus, the juncture of shell wall 12 and insert 22 provides a smooth continuous surface inboard and outboard.

Figure 3:
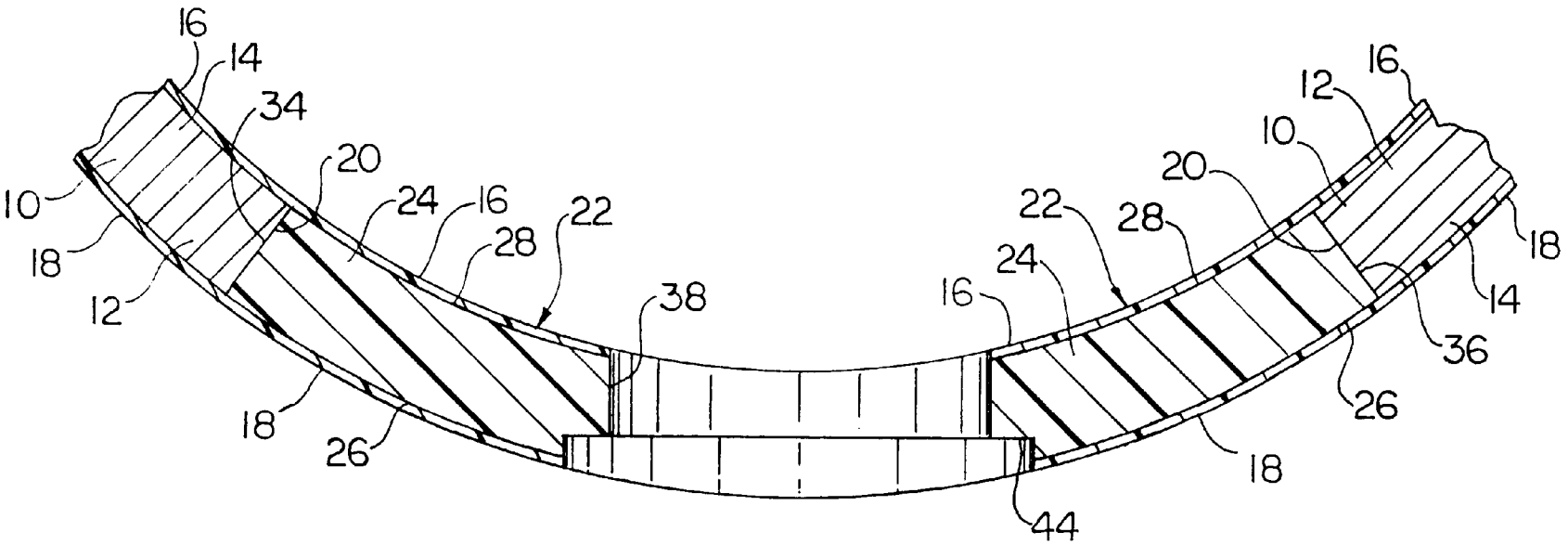
FIG. 3 is a transverse sectional view showing the insert in place in a portion of a pressure vessel.

Referring to FIG. 3, it will be seen that the composite plate 24 is provided, as by machining, with a suitable configuration for the closure to be mounted thereon. For example, the plate shown in FIG. 3 is configured to mount an acoustic transducer (not shown). The plate 24 is provided with a aperture 38 by which electrical components, including a "pinger" are inserted into shell 10, and is provided with a recess 44 for receiving the transducer and backplate portions, and any protective grid and appropriate seals (not shown). Obviously, recess 44 can be positioned facing the interior of the vessel for applications requiring that construction.

There is thus provided an insert which may be formed of the same thickness as the pressure vessel shell wall, which is of sufficient strength to support an aperture therein, and which exhibits a modulus of elasticity relatively close to the through the thickness modulus of the pressure vessel shell wall in which the insert is disposed.

There is further provided an insert which is about one-third lighter than the usual aluminum insert.

There is still further provided an insert which is susceptible to easy changes in manufacture which result in an insert suited for use in conjunction with other than fiber glass-reinforced epoxy shell wall skins. If a different skin is used on the shell, the fiber volume of the glass in the compression molded epoxy can be varied to match a modulus of elasticity of the skin.

It is to be understood that the present invention is by no means limited to the particular constructions herein disclosed and/or shown in the drawings, but also comprises any modifications or equivalents within the scope of the claims.

What is claimed is:

1. In combination, a curved pressure vessel shell wall having a core layer substantially of uniform thickness sandwiched between inboard and outboard skins, the skins being provided with a selected thickness, and having a first modulus of elasticity in directions through the skin thicknesses, a second modulus of elasticity in a widthwise direction, and a third modulus of elasticity in a longitudinal direction, said wall defining an opening extending therethrough; and an insert disposed in said opening in the shell wall, said insert being adapted to support a closure member and comprising a plate having a curved outboard surface defining a continuation of an outboard surface of said wall outboard skin, and a concentrically curved inboard surface defining a continuation of an inboard surface of said wall inboard skin, said plate being provided with a curvature equal to the curvature of said wall of said shell, said plate outboard and inboard surfaces being interconnected by planar outer edge surfaces generally normal to outboard and inboard plate surfaces, and defining an aperture extending therethrough from said plate outboard surface to said plate inboard surface, said plate being substantially of uniform thickness substantially equal to the thickness of the pressure vessel shell wall, and said plate having a modulus of elasticity within about 30% of the first modulus of elasticity of the pressure vessel shell wall inboard and outboard skins, said plate being configured to mount the closure member in the aperture.

2. The combination in accordance with claim 1 wherein said plate modulus of elasticity is within about 30% of the second modulus of elasticity of the pressure vessel shell wall inboard and outboard skins.

3. The combination in accordance with claim 2 wherein said plate modulus of elasticity is within about 15% of the third modulus of elasticity of the pressure vessel shell wall inboard and outboard skins.

4. The combination in accordance with claim 3 wherein said plate modulus of elasticity is less than said third modulus of elasticity.

5. The combination in accordance with claim 3 wherein said plate modulus of elasticity exceeds said first modulus of elasticity and is less than said second and third moduli of elasticity.

6. The combination in accordance with claim 2 wherein said plate modulus of elasticity is less than said second modulus of elasticity.

7. The combination in accordance with claim 2 wherein said plate is provided with a modulus of elasticity within about 30% of the vessel shell wall second modulus of elasticity in directions extending along said curvature of said plate.

8. The combination in accordance with claim 1 wherein said plate modulus of elasticity is about 2.3 million p.s.i.

9. The combination in accordance with claim 8 wherein said plate modulus of elasticity is greater than said first modulus of elasticity.

10. The combination in accordance with claim 1 wherein said plate is non-metallic.

11. The combination in accordance with claim 10 wherein said plate is of compression molded glass-reinforced epoxy.

12. The combination in accordance with claim 11 wherein said molded epoxy includes glass fibers randomly dispersed therein.

13. The combination in accordance with claim 11 wherein the density of said molded epoxy is about 0.066 lbs/in$^3$.

14. The combination in accordance with claim 13 wherein the compressive yield strength of said plate is up to about 35,000 p.s.i.

15. The combination in accordance with claim 1 wherein said plate is of a thickness of about 1.1 inch and each of said skins is of a thickness of about 0.1 inch.

16. A composite material pressure vessel comprising:

a cylindrical pressure vessel shell wall having a core layer substantially of uniform thickness sandwiched between inboard and outboard skins, the skins being provided with a selected thickness, and having a first modulus of elasticity in directions through the skin thicknesses, a second modulus of elasticity in a widthwise direction, and a third modulus of elasticity in a longitudinal direction, said shell wall having an opening therein and extending therethrough;

an insert positioned in said shell wall opening with said inboard and outboard skins extending over said insert and being mounted thereto, said insert being adapted to support a closure member and comprising:

a plate having a curved outboard surface defining a continuation of said shell wall outboard skin and a concentrically curved inboard surface defining a continuation of said shell wall inboard skin, said shell wall outboard and inboard surfaces being interconnected by planar outer edge surfaces generally normal to said outboard and inboard plate surfaces, said plate being provided with a curvature equal to the curvature of said shell wall and defining an aperture extending therethrough from said plate outboard surface to said plate inboard surface;

said plate being substantially of uniform thickness substantially equal to the thickness of the core layer; and said plate having a modulus of elasticity within about 30% of the first modulus of elasticity of the pressure vessel shell wall inboard and outboard skins.

* * * * *